US010019925B2

(12) United States Patent
Wu

(10) Patent No.: US 10,019,925 B2
(45) Date of Patent: Jul. 10, 2018

(54) ELECTRONIC DEVICE CAPABLE OF DISPLAYING AND PERFORMING COLOR COMPENSATION AND COLOR COMPENSATION METHOD

(71) Applicant: MEDIATEK INC., Hsin-Chu (TW)

(72) Inventor: Yi-Ruei Wu, Tainan (TW)

(73) Assignee: MEDIATEK INC., Hsin-Chu (TW)

( * ) Notice: Subject to any disclaimer, the term of this patent is extended or adjusted under 35 U.S.C. 154(b) by 92 days.

(21) Appl. No.: 14/826,213

(22) Filed: Aug. 14, 2015

(65) Prior Publication Data

US 2017/0039919 A1 Feb. 9, 2017

Related U.S. Application Data

(63) Continuation-in-part of application No. 14/820,528, filed on Aug. 6, 2015.

(51) Int. Cl.

*G09G 5/10* (2006.01)
*G09G 3/20* (2006.01)
*G09G 5/02* (2006.01)

(52) U.S. Cl.

CPC ..... *G09G 3/2003* (2013.01); *G09G 5/02* (2013.01); *G09G 5/10* (2013.01); (Continued)

(58) Field of Classification Search

CPC ..... G09G 3/2003; G09G 5/02; G09G 5/06; G09G 2320/0666; G09G 2320/0242; G09G 2320/0626; G09G 2320/0276 (Continued)

(56) References Cited

U.S. PATENT DOCUMENTS

2012/0293473 A1* 11/2012 Lee ..... G09G 5/00 345/207
2017/0018239 A1* 1/2017 Chen ..... G09G 3/3607

FOREIGN PATENT DOCUMENTS

CN 101009075 A 8/2007
CN 102800301 A 11/2012
(Continued)

OTHER PUBLICATIONS

State Intellectual Property Office, First Office Action regarding China Patent Application No. 201510967641.9, May 9, 2018.

*Primary Examiner* — Rodney Amadiz
(74) *Attorney, Agent, or Firm* — Han IP Corporation; Andy M. Han

(57) ABSTRACT

The disclosure provides an electronic device capable of displaying and performing color compensation and a color compensation method. The color compensation method comprises: obtaining one or more brightness values for an original image from at least one of a screen brightness value and an ambient brightness value of the electronic device; determining whether each of the one or more brightness values is lower than a corresponding one of one or more threshold values, respectively; and enabling a color enhancement mode in events where each of the one or more brightness values is lower than the corresponding one of one or more threshold values, respectively, wherein the color enhancement mode comprises performing a color saturation compensation to enhance a saturation of the original image for display on a screen of the electronic device.

19 Claims, 6 Drawing Sheets

(52) U.S. Cl.
CPC ..... *G09G 2320/0242* (2013.01); *G09G 2320/0626* (2013.01); *G09G 2320/0666* (2013.01); *G09G 2340/06* (2013.01); *G09G 2340/14* (2013.01); *G09G 2360/144* (2013.01); *G09G 2360/145* (2013.01)

(58) Field of Classification Search
USPC ..... 345/83, 88–89, 690
See application file for complete search history.

(56) References Cited

FOREIGN PATENT DOCUMENTS

| | | | |
|---|---|---|---|
| CN | 104299600 | A | 1/2015 |
| CN | 104575448 | A | 4/2015 |
| CN | 104658512 | A | 5/2015 |

* cited by examiner

ELECTRONIC DEVICE CAPABLE OF DISPLAYING AND PERFORMING COLOR COMPENSATION AND COLOR COMPENSATION METHOD

CROSS REFERENCE TO RELATED APPLICATION

This application is a continuation-in-part of U.S. application Ser. No. 14/820,528, which was filed on 2015 Aug. 6, entitled "METHOD FOR ADJUSTING DISPLAY OF ELECTRONIC DEVICE AND ELECTRONIC DEVICE CAPABLE OF ADJUSTING DISPLAY".

BACKGROUND

The disclosed embodiments of the present invention relate to an electronic device and a color compensation method, and more particularly, an electronic device capable of displaying and performing color saturation compensation and a color compensation method to enhance saturation of images for display.

In general, when it is dark for the human eyes (i.e. the screen brightness and/or ambient brightness are too low to be sensed by the human eyes), it is very hard for the human eyes to identify colors of objects, and thus the display quality is degraded. Please refer to FIG. 1. FIG. 1 is a simplified diagram of the color for the human eyes and a human eye color sensibility function, wherein S(i) represents the human eye color sensibility function, and i represents the light brightness into human eyes. As shown in FIG. 1, when the light brightness into human eyes is lower, the human eye color sensibility becomes lower.

SUMMARY

One of many objectives of the disclosure is to provide an electronic device capable of displaying and performing color compensation and a color compensation method to enhance saturation of images to be displayed on a screen of the electronic device. The color saturation may be performed in a situation that screen brightness and/or ambient brightness are too low, so as to solve the problem that display quality degrades in the situation.

The other objective of the disclosure is to more accurately compensate colors of images by using human eye color sensibility information. According to the human eye color sensibility information, an original color for display can be compensated to obtain a compensated color suitable for perception by human. Consequently, the color finally perceived by human eyes can be suitable for human eyes even in darkness or any conditions where the human eye sensibility becomes weak.

In accordance with an embodiment of the present invention, an electronic device capable of displaying and performing color compensation is disclosed. The electronic device comprises: a screen, configured to display images; a sensor, configured to sense ambient light of the electronic device; and a processor, configured to receive an original image, obtain one or more brightness values for the original image from at least one of a screen brightness value of the screen and an ambient brightness value generated according to a sensing result of the sensor, determine whether each of the one or more brightness values is lower than a corresponding one of one or more threshold values, respectively, and enable a color enhancement mode in events where each of the one or more brightness values is lower than the corresponding one of one or more threshold values, respectively. In the color enhancement mode, the processor performs a color saturation compensation to enhance a saturation of the original image and provides a compensated image for display on the screen according to the compensation result.

In accordance with an embodiment of the present invention, an electronic device capable of displaying and performing color compensation is disclosed. The electronic device comprises: a screen, configured to display images; a sensor, configured to sense ambient light of the electronic device; and a processor, configured to obtain one or more brightness values for an original image from at least one of a screen brightness value of the screen and an ambient brightness value generated according to a sensing result of the sensor, determine whether to enable a color enhancement mode of the electronic according to one or more brightness values, wherein in the color enhancement mode, the processor performs a color saturation compensation to enhance a saturation of the original image according to human eye color sensibility information, and the screen displays a compensated image according to the compensation result.

In accordance with an embodiment of the present invention, a processor capable of performing color compensation in an electronic device comprising a screen is disclosed. The processor comprises: a display unit, configured to generate an original image; and a compensation unit, configured to receive the original image, obtain one or more brightness values for the original image from at least one of a screen brightness value of the screen and an ambient brightness value of the electronic device, determine whether each of the one or more brightness values is lower than a corresponding one of one or more threshold values, respectively, and enable a color enhancement mode in events where each of the one or more brightness values is lower than the corresponding one of one or more threshold values, respectively; wherein in the color enhancement mode, the compensation unit performs a color saturation compensation to enhance a saturation of the original image and provides a compensation image to be displayed on the screen of the electronic device according to the compensation result.

In accordance with an embodiment of the present invention, a processor capable of performing color compensation in an electronic device comprising a screen is disclosed. The processor comprises: a display unit, configured to generate an original image; and a compensation unit, configured to receive the original image, obtain one or more brightness values, and determine whether to enable a color enhancement mode of the electronic according to one or more brightness values, wherein in the color enhancement mode, the processor performs a color saturation compensation to enhance a saturation of the original image according to human eye color sensibility information, and the screen displays compensated images according to the compensation result.

In accordance with an embodiment of the present invention, a color compensation method for compensating images for display in an electronic device comprising a screen is disclosed. The color compensation method comprises: obtaining one or more brightness values from at least one of a screen brightness value and an ambient brightness value of the electronic device for an original image; determining whether each of the one or more brightness values is lower than a corresponding one of one or more threshold values, respectively; and enabling a color enhancement mode in events where each of the one or more brightness values is lower than the corresponding one of one or more threshold values, respectively, wherein the color enhancement mode comprises performing a color saturation compensation to enhance a saturation of the original image for display on a screen of the electronic device.

In accordance with an embodiment of the present invention, a color compensation method for compensating images for display in an electronic device comprising a screen is disclosed. The color compensation method comprises: obtaining one or more brightness values for an original image; and determining whether to enable a color enhancement mode according to the one or more brightness values, wherein in the color enhancement mode, a color saturation compensation is performed to enhance a saturation of the original image according to human eye color sensibility information, and a compensated image is provided to be displayed on the screen according to the compensation result.

In accordance with an embodiment of the present invention, a color compensation method for an electronic device is disclosed. The color compensation method comprises: obtaining one or more brightness values for an original image, wherein the one or more brightness values are either or both a screen brightness value and an ambient brightness value of the electronic device; determining whether each of the one or more brightness values is lower than a corresponding one of one or more threshold values, respectively; and enabling a color enhancement mode in events where each of the one or more brightness values is lower than the corresponding one of one or more threshold values, respectively, wherein the color enhancement mode comprises performing a color saturation compensation to enhance a saturation of the original image and a compensated image is provided for display on a screen of the electronic device according to the compensation result.

Briefly summarized, the color compensation method and the processor and the electronic device disclosed in some embodiments of the present invention can perform the color saturation compensation to enhance the saturation of images for display in events that the screen brightness and/or ambient brightness are too low. In other words, even the current light brightness into the human eyes is very low (i.e. it is dark for the human eyes), the color saturation compensation can be performed to enhance the display quality for the human eyes. Furthermore, the color compensation method and the processor and the electronic device disclosed in some other embodiments of the present invention can perform color saturation compensation to enhance the saturation of images for display according to human eye color sensibility information. With reference to human eye color sensibility information, an appropriate or optimal compensation may be achieved to accommodate sensing capabilities of human eyes.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, in events where one device is coupled to another device, that connection may be through a direct electrical connection, or through an indirect electrical connection via other devices and connections.

Figure 1:
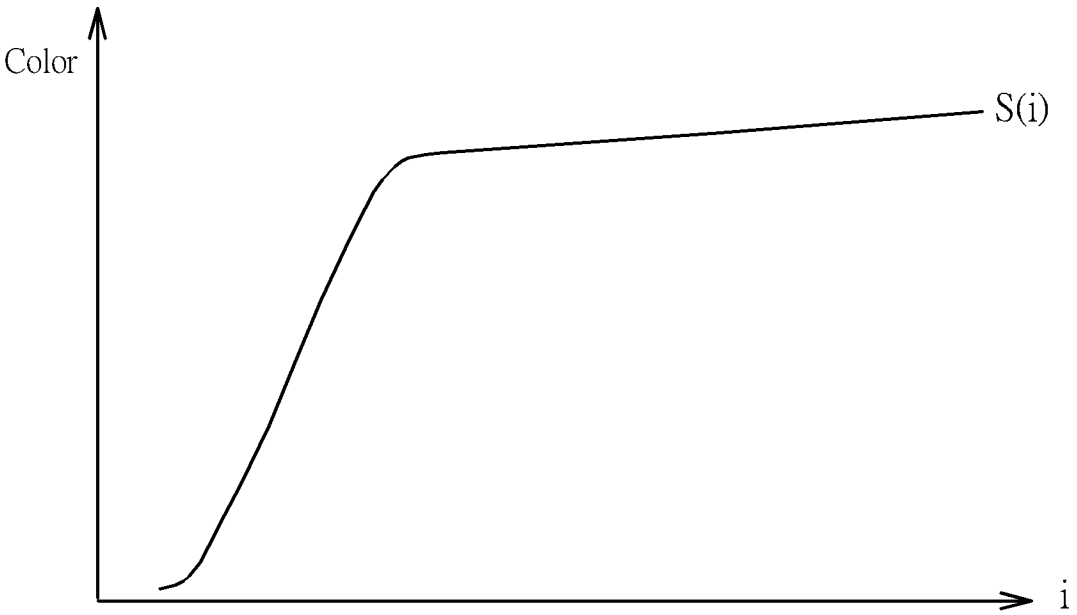
FIG. 1 is a simplified diagram of the color for the human eyes and a human eye color sensibility function.
Figure 2:
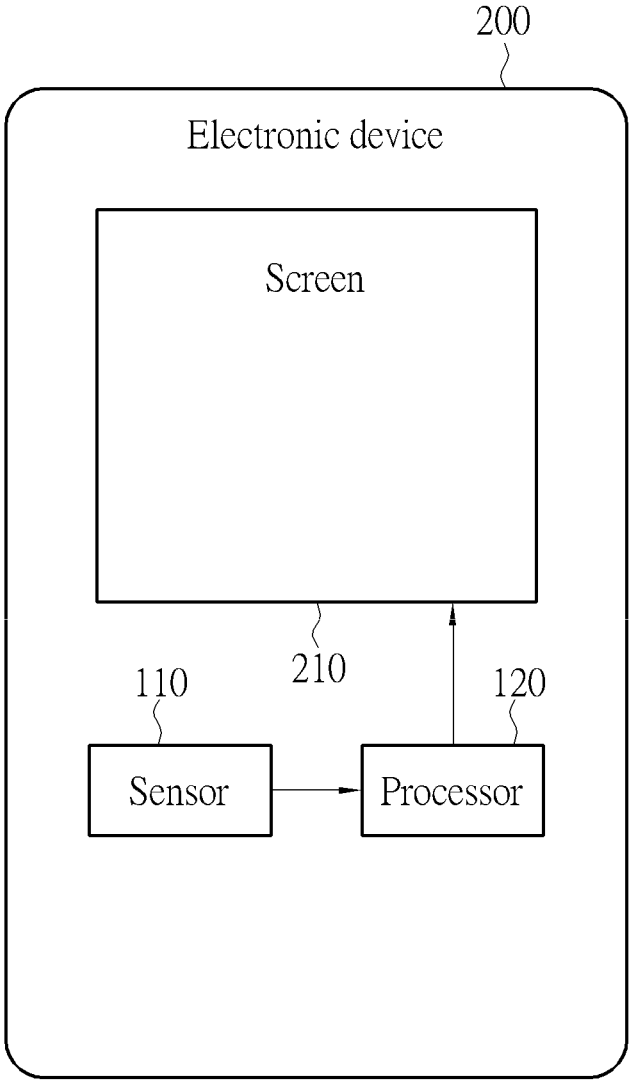
FIG. 2 is a simplified diagram of a color compensation system for an electronic device in accordance with an embodiment of the present invention.

Please refer to FIG. 2. FIG. 2 is a simplified diagram of an electronic device 200 capable of displaying and performing color compensation in accordance with an embodiment of the present invention, wherein the electronic device 200 comprises a screen 210, a sensor 110, and a processor 120, and the electronic device 200 can be a smartphone, a tablet, a laptop, a handheld computing device, or a television. The screen 210 is configured to display images. The sensor 110 is configured to sense ambient light of the electronic device 200.

The processor 120 can be coupled to the sensor 110, and configured to receive an original image and obtains one or more brightness values for the original image from at least one of a screen brightness value of the screen 210 and an ambient brightness value generated according to a sensing result of the sensor 110. The processor 120 can then determine whether each of the one or more brightness values is lower than a corresponding one of one or more threshold values, respectively, and enable a color enhancement mode in events where each of the one or more brightness values is lower than the corresponding one of one or more threshold values, respectively.

It is noted that the screen brightness value can be determined according to a displayed content brightness value and one of a backlight brightness value and an ambient brightness value. In some types of display, the screen brightness value can be a multiple of the displayed content brightness value and the backlight brightness value. In other types of display, such as reflective displays, the screen brightness value can be a multiple of the displayed content brightness value and the ambient brightness value.

In the color enhancement mode, the processor 120 can perform a color saturation compensation to enhance a saturation of the original image, and the screen 210 displays can display a compensated image according to the compensation result. Due to the color saturation compensation, even the current light brightness into the human eyes is very low (i.e.

it is dark for the human eyes), the display quality can be enhanced for the human eyes.

In an embodiment, the processor 120 can be configured to determine whether the screen brightness value is lower than a threshold value, and enabling a color enhancement mode 200 in events where the screen brightness value is lower than the threshold value, wherein the color enhancement mode comprises performing a color saturation compensation to enhance a saturation of the original image and providing a compensated image for display on the screen 210 of the electronic device 200.

In another embodiment, the sensor 110 is utilized for obtaining an environment brightness value of the electronic device 200. The processor 120 is coupled to the sensor 110, and utilized for determining whether the ambient brightness value is lower than a threshold value, and enabling a color enhancement mode 200 in events where the ambient brightness value is lower than the threshold value, wherein the color enhancement mode comprises performing a color saturation compensation to enhance a saturation of the original image and providing a compensated image for display on the screen 210 of the electronic device 200.

In further another embodiment, the processor 120 can be configured to determine whether the screen brightness value is lower than a first threshold value and whether the ambient brightness value is lower than a second threshold value, and enabling a color enhancement mode 200 in events where the screen brightness value is lower than the first threshold value and/or the ambient brightness value is lower than the second threshold value, wherein the color enhancement mode comprises performing a color saturation compensation to enhance a saturation of the original image and providing a compensated image for display on the screen 210 of the electronic device 200.

In addition, the color saturation compensation can be performed according to human eye color sensibility information. Specifically, the human eye color sensibility information can comprise an optimal human eye color sensibility value and a current human eye color sensibility value. In performing the color saturation compensation, the processor 120 can determine a compensation factor according to a ratio of the optimal human eye color sensibility value S(K) to the current human eye color sensibility value S(I') and compensates the saturation of the original image with the compensation factor S(K)/S(I'). Generally, the color saturation compensation can be performed according to an original color of image $C_d$, a human eye color sensibility function S, an optimal screen brightness value K, and the screen brightness value i. Mathematically, the color saturation compensation can be represented by $C_f$=f ($c_d$, S, K, i), where $C_f$ denotes a compensated color for display, and f( ) denotes a compensating function for converting the variables $C_d$, S, K, i to the compensation result $C_f$.

In an embodiment of a more detailed structure of the processor 120, the processor 120 can comprise: a display unit configured to generate an original image; and a compensation unit configured to receive the original image, obtain one or more brightness values for the original image from at least one of a screen brightness value of the screen and an ambient brightness value of the electronic device, and determine whether each of the one or more brightness values is lower than a corresponding one of one or more threshold values, respectively, and enable a color enhancement mode in events where each of the one or more brightness values is lower than the corresponding one of one or more threshold values, respectively; wherein in the color enhancement mode, the compensation unit performs a color saturation compensation to enhance a saturation of the original image and provides a compensated image to be displayed on the screen of the electronic device.

In another embodiment of the present invention, the processor 120 can be configured to obtain one or more brightness values, and determine whether to enable a color enhancement mode of the electronic according to one or more brightness values. In other words, the processor 120 can enable the color enhancement mode in a situation that a predetermined condition of the one or more brightness values is satisfied, wherein the predetermined condition can be designed according to different design requirements.

In the color enhancement mode, the processor 120 can perform a color saturation compensation to enhance a saturation of the original image according to human eye color sensibility information, and provides a compensated image to the screen according to the compensation result such that the screen displays the compensated image. With reference to human eye color sensibility information, an appropriate or optimal compensation may be achieved to accommodate sensing capabilities of human eyes.

In an embodiment of a more detailed structure of the processor 120, the processor 120 can comprise: a display unit configured to generate an original image; and a compensation unit configured to receive the original image, obtain one or more brightness values for the original image, and determine whether to enable a color enhancement mode of the electronic according to one or more brightness values. In the color enhancement mode, the processor can perform a color saturation compensation to enhance a saturation of the original image according to human eye color sensibility information and provides a compensated image according to the compensation result such that the screen displays the compensated image.

Figure 3:
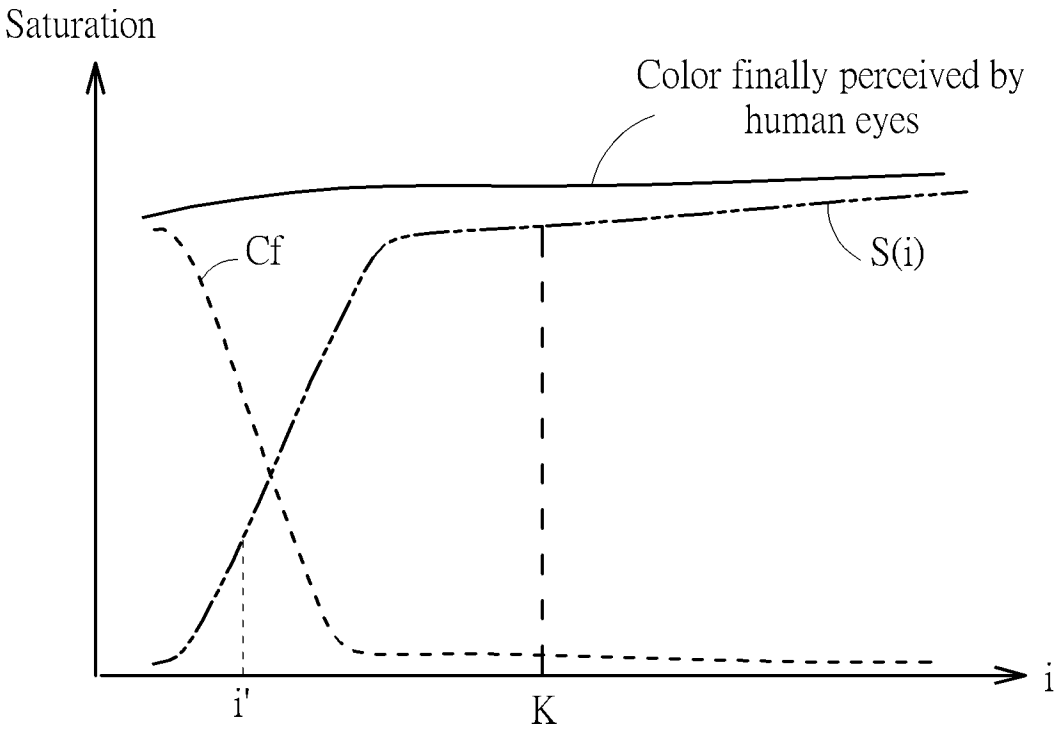
FIG. 3 is a simplified diagram of the color saturation compensation performed by the electronic device in accordance with an embodiment of the present invention.

Please refer to FIG. 3. FIG. 3 is a simplified diagram of the color saturation compensation performed by the electronic device 200 in accordance with an embodiment of the present invention, wherein $C_f$ represents a compensated color for display, S(i) represents a human eye color sensibility function, and K represents an optimal screen brightness value. When i=K, S(K) represents an optimal human eye color sensibility value. The diagram also shows a curve representing the color finally perceived by human eyes, which results from the compensated color for display $C_f$ and the human eye color sensibility function S(i). The diagram may be shown for a fixed value of an original color for image $C_d$, which is not illustrated. In addition, i' represents a current light brightness into human eyes. The current light brightness into human eyes can be equal to the screen brightness value. The screen brightness value can be equal to the displayed content brightness value times the backlight brightness value or the environment brightness value.

Specifically, the function of the processor 120 of performing the color saturation compensation comprises: obtaining a current human eye color sensibility value S(i') according to the human eye color sensibility function S(i) and the screen brightness value i'; obtaining an optimal human eye color sensibility value S(K) according to the human eye color sensibility function S(i) and the optimal screen brightness value K; and compensating the saturation of the original image according to a ratio of the optimal human eye color sensibility value S(K) to the current human eye color sensibility value S(i'). That is, $C_f$=$C_d$*S(K)/S(i'), where $C_d$ represents an original color for image. In this way, even the current light brightness into the human eyes is very low (i.e. it is dark for the human eyes), the present invention can perform the color saturation compensation to enhance the display quality for the human eyes.

In addition, the color enhancement mode of an embodiment can further comprise: transforming the original image from a first color domain to a second color domain; performing the color saturation compensation under the second color domain; and transforming the original image from the second color domain to the first color domain. The first color domain can be a RGB domain, a CMYK domain, a RGBW domain, a HSV domain, a HSL domain, a YUV domain, or a YCbCr domain. In addition, the second color domain can have separated luma and chroma. For example, the second color domain can be a HSV domain, a HSL domain, a YUV domain, or a YCbCr domain.

Figure 4:
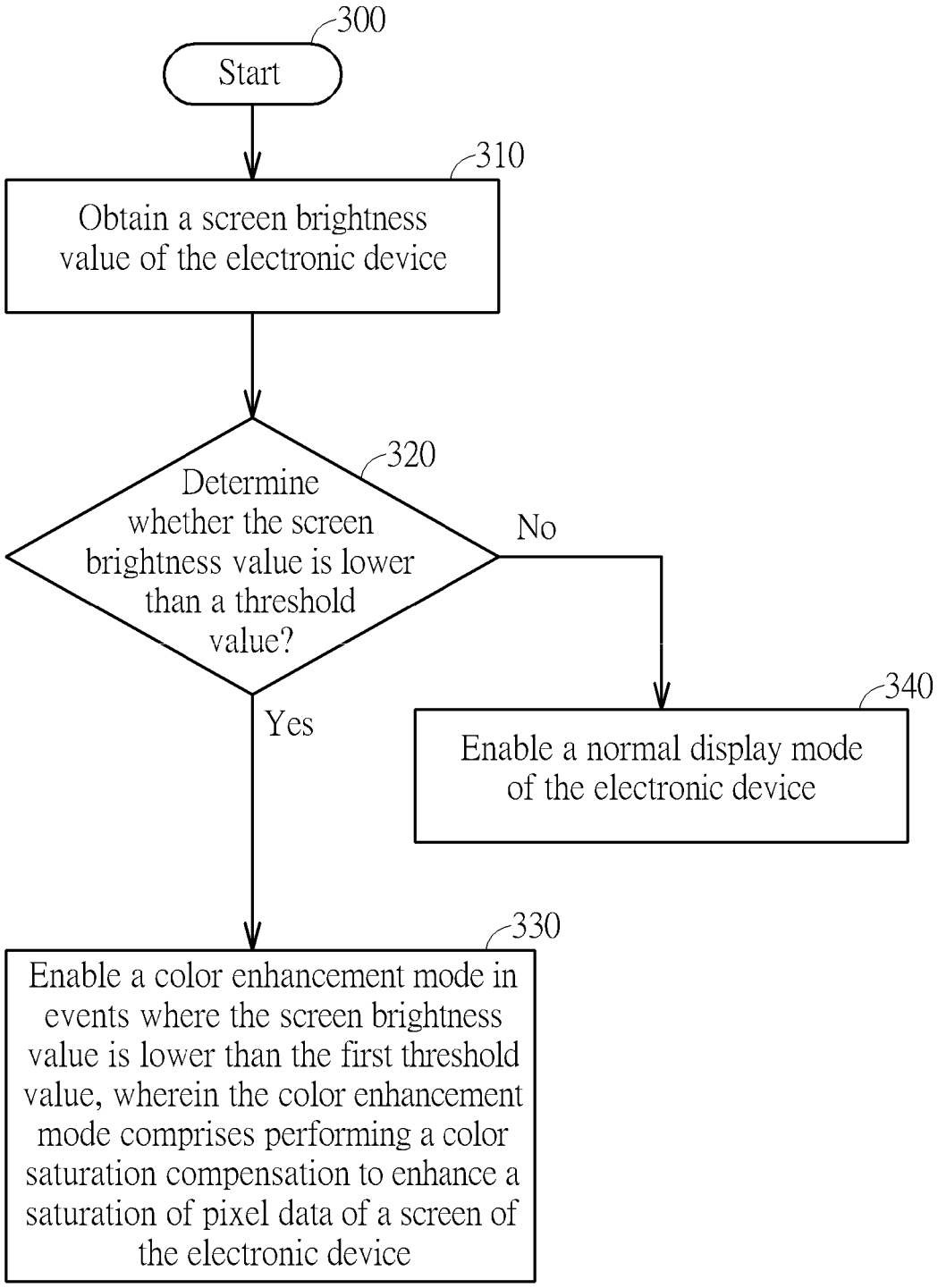
FIG. 4 is a first exemplary flowchart showing a color compensation method in accordance with the operation schemes of the electronic device in FIG. 2.

Please refer to FIG. 4. FIG. 4 is a first exemplary flowchart showing a color compensation method in an embodiment. The flowchart in FIG. 4 may (but non-limitedly) performed in accordance with the operation schemes of the electronic device 200 in the above embodiment. It is also noted that, provided that the result is substantially the same, the steps in FIG. 4 are not required to be executed in the exact order shown in FIG. 4.

The color compensation method in accordance with the above embodiment of the electronic device 200 in the present invention comprises the following steps:

Step 300: Start.

Step 310: Obtain a screen brightness value for an original image of the electronic device.

Step 320: Determine whether the screen brightness value is lower than a first threshold value; in events where the screen brightness value is lower than the threshold value, go to Step 330, and in events where the ambient brightness value is not lower than the threshold value, go to Step 340.

Step 330: Enable a color enhancement mode in events where the screen brightness value is lower than the first threshold value, wherein the color enhancement mode comprises performing a color saturation compensation to enhance a saturation of the original image.

Step 340: Enable a normal display mode of the electronic device.

For example, the step of performing the color saturation compensation comprises: obtaining a current human eye color sensibility value S(i') according to a human eye color sensibility function S(i) and the screen brightness value i'; obtaining an optimal human eye color sensibility value S(K) according to the human eye color sensibility function S(i) and an optimal screen brightness value K; and compensating the saturation of the original image according to a ratio of the optimal human eye color sensibility value S(K) to the current human eye color sensibility value S(i').

In addition, the color enhancement mode can further comprises: transforming the original image of the screen from a first color domain to a second color domain; performing the color saturation compensation under the second color domain; and transforming the original image from the second color domain to the first color domain, wherein the first color domain is a RGB domain, a CMYK domain, a RGBW domain, a HSV domain, a HSL domain, a YUV domain, or a YCbCr domain. The second color domain has separated luma and chroma, wherein the second color domain is a HSV domain, a HSL domain, a YUV domain, or a YCbCr domain.

Figure 5:
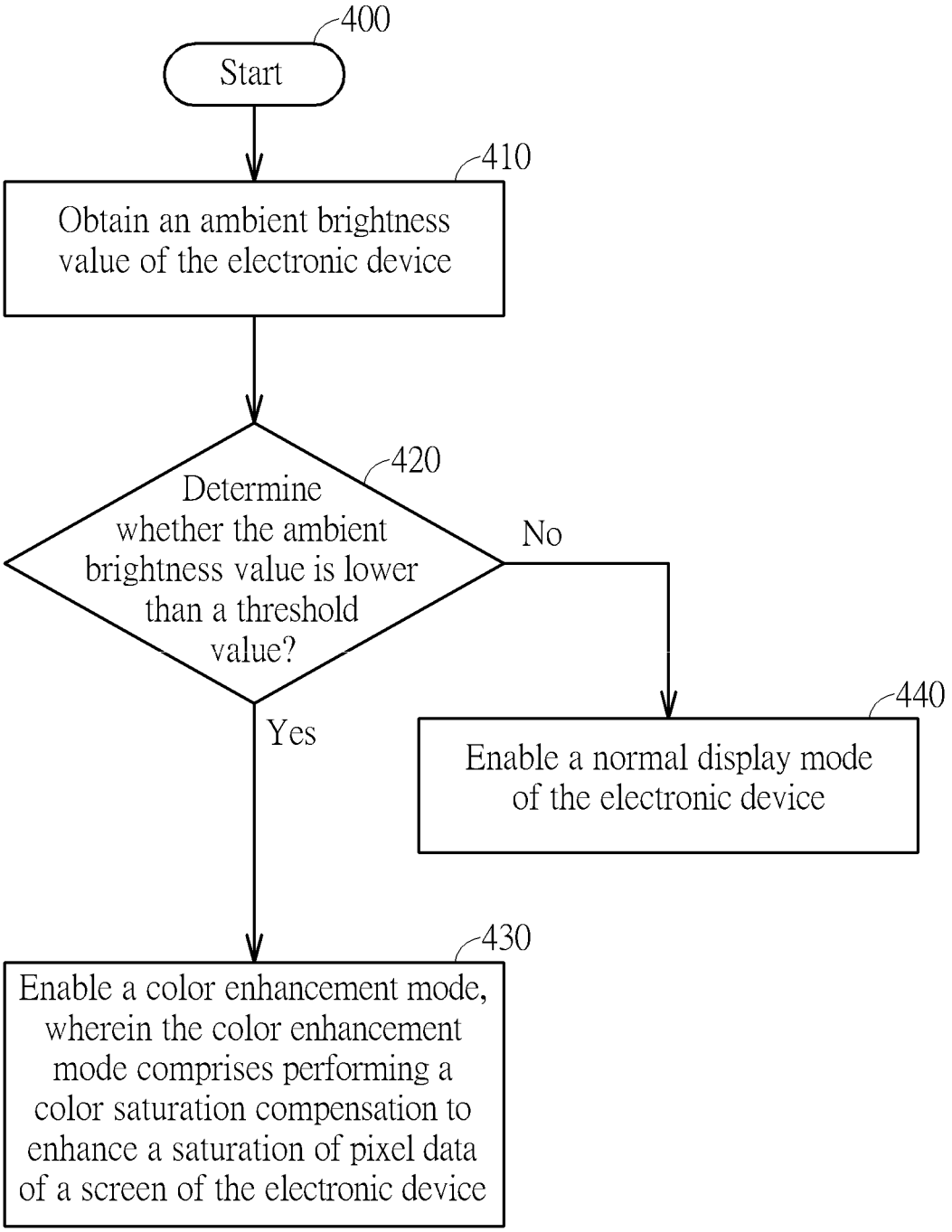
FIG. 5 is a second exemplary flowchart showing a color compensation method in accordance with the operation schemes of the electronic device in FIG. 2.

Please refer to FIG. 5. FIG. 5 is a second exemplary flowchart showing a color compensation method in another embodiment. The flowchart of FIG. 5 can be performed (but not limitedly) in accordance with the operation schemes of the electronic device 200 in the above embodiment. Provided that the result is substantially the same, the steps in FIG. 5 are not required to be executed in the exact order shown in FIG. 5. The color compensation method in accordance with the above embodiment of the electronic device 200 in the present invention comprises the following steps:

Step 400: Start.

Step 410: Obtain an ambient brightness value of the electronic device.

Step 420: Determine whether the ambient brightness value is lower than a threshold value; in events where the ambient brightness value is lower than the threshold value, go to Step 430, and in events where the ambient brightness value is not lower than the threshold value, go to Step 440.

Step 430: Enable a color enhancement mode, wherein the color enhancement mode comprises performing a color saturation compensation to enhance a saturation of an original image for display on a screen of the electronic device.

Step 440: Enable a normal display mode of the electronic device.

For example, the step of performing the color saturation compensation comprises: obtaining a current human eye color sensibility value according to a human eye color sensibility function and the ambient brightness value; and compensating the saturation of the original image an according to a ratio of the optimal human eye color sensibility value to the current human eye color sensibility value. In addition, the color enhancement mode can further comprises: transforming the original image of the screen from a first color domain to a second color domain; performing the color saturation compensation under the second color domain; and transforming the original image from the second color domain to the first color domain, wherein the first color domain is a RGB domain, a CMYK domain, a RGBW domain, a HSV domain, a HSL domain, a YUV domain, or a YCbCr domain. The second color domain has separated luma and chroma, wherein the second color domain is a HSV domain, a HSL domain, a YUV domain, or a YCbCr domain.

It is noted that FIG. 5 differs from FIG. 4 mainly in that step 420 replacing step 320. Therefore, more details of the steps in FIG. 5 can be analogized from those of FIG. 4 and are omitted here for brevity.

Figure 6:
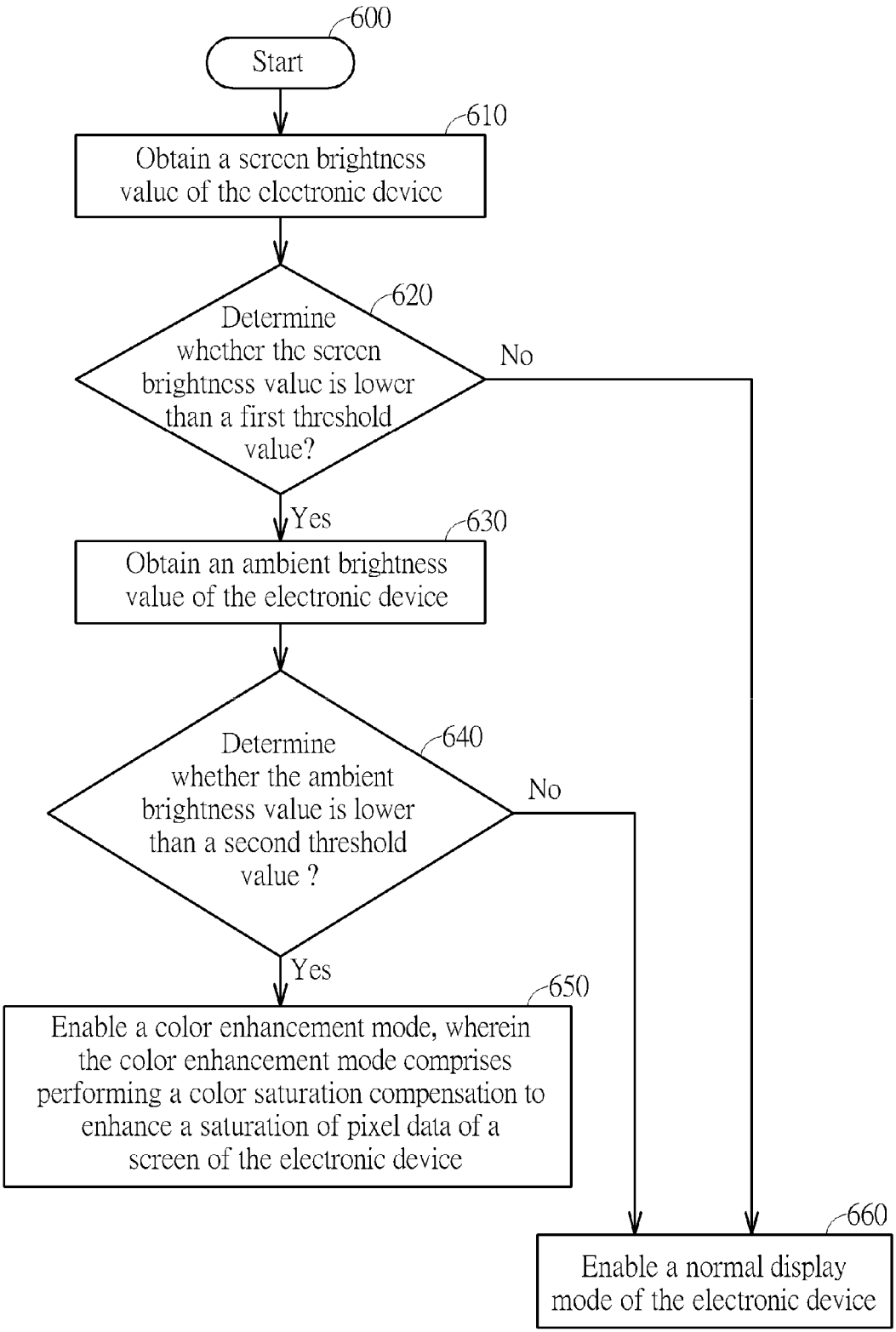
FIG. 6 is a third exemplary flowchart showing a color compensation method in accordance with the operation schemes of the electronic device in FIG. 2.

Please refer to FIG. 6. FIG. 6 is a third exemplary flowchart showing a color compensation method in accordance with the operation schemes of the electronic device 200 in the above embodiment. Provided that the result is substantially the same, the steps in FIG. 6 are not required to be executed in the exact order shown in FIG. 6. The color compensation method in accordance with the above embodiment of the electronic device 200 in the present invention comprises the following steps:

Step 600: Start.

Step 610: Obtain a screen brightness value of the electronic device for an original image.

Step 620: Determine whether the screen brightness value is lower than a first threshold value; in events where the screen brightness value is lower than the first threshold value, go to Step 630, and in events where the screen brightness value is not lower than the first threshold value, go to Step 660.

Step 630: Obtain an ambient brightness value of the electronic device.

Step 640: Determine whether the ambient brightness value is lower than a second threshold value; in events where the ambient brightness value is lower than the second threshold value, go to Step 650, and in events where the ambient brightness value is not lower than the second threshold value, go to Step 660.

Step 650: Enable a color enhancement mode, wherein the color enhancement mode comprises performing a color saturation compensation to enhance a saturation of the original image for display on a screen of the electronic device.

Step 660: Enable a normal display mode of the electronic device.

For example, the step of performing the color saturation compensation comprises: obtaining a current human eye color sensibility value according to a human eye color sensibility function and the screen brightness value; obtaining an optimal human eye color sensibility value according to the human eye color sensibility function and an optimal screen brightness value; and compensating the saturation of the original image according to a ratio of the optimal human eye color sensibility value to the current human eye color sensibility value. In addition, the color enhancement mode can further comprises: transforming the original image of the screen from a first color domain to a second color domain; performing the color saturation compensation under the second color domain; and transforming the original image from the second color domain to the first color domain, wherein the first color domain is a RGB domain, a CMYK domain, a RGBW domain, a HSV domain, a HSL domain, a YUV domain, or a YCbCr domain. The second color domain has separated luma and chroma, wherein the second color domain is a HSV domain, a HSL domain, a YUV domain, or a YCbCr domain.

It is noted that FIG. 6 differs from FIG. 4 mainly in the steps 630-650. Therefore, more details of the steps in FIG. 6 can be analogized from those of FIG. 4 and are omitted here for brevity.

An embodiment of the disclosure also provides an electronic device such as a smart phone or a tablet. When the electronic device is placed in a dark environment (i.e., the ambient brightness is lower than a threshold), either or both the screen brightness and the backlight brightness can be manually or automatically adjusted to be lower than a threshold. And then the enhancement mode can be enabled. The saturation of images can be adjusted based on at least one of contents to be displayed, the backlight brightness, and the detected environment/backlight brightness in the enhancement mode.

An embodiment of the disclosure also provides an electronic device such as a television. When light is turned off, either or both the screen brightness and the backlight brightness can be manually or automatically adjusted to be lower than a threshold. The saturation of images can then be adjusted automatically based on the screen brightness. In addition, compensation strength can be altered by the user. Furthermore, the compensation strength preferred by the user can be saved by the electronic device.

An embodiment of the disclosure also provides a non-transitory storage medium or a computer-readable recording medium. The non-transitory storage medium records at least one program instruction or program code. After being loaded into an electronic device with a screen, the at least one program instruction or program code is executed to carry out the method provided by each embodiment described above.

For example, after the at least one program instruction or program code in the computer-readable recording medium is loaded into the electronic device 200 illustrated in FIG. 2, the electronic device 200 runs the at least one program instruction or program code to execute the method provided by one of the embodiments described above. The computer-readable recording medium may be implemented as a memory accessible to the processor 120 in FIG. 2. The computer-readable recording medium may be a read-only memory (ROM), a random-access memory (RAM), a CD-ROM, a tape, a floppy disk, or an optical data storage device.

Various functional components or blocks have been described herein. As will be appreciated by persons skilled in the art, the functional blocks will preferably be implemented through circuits (either dedicated circuits, or general purpose circuits, which operate under the control of one or more processors and coded instructions), which will typically comprise transistors that are configured in such a way as to control the operation of the circuity in accordance with the functions and operations described herein. As will be further appreciated, the specific structure or interconnections of the transistors will typically be determined by a compiler, such as a register transfer language (RTL) compiler. RTL compilers operate upon scripts that closely resemble assembly language code, to compile the script into a form that is used for the layout or fabrication of the ultimate circuitry. Indeed, RTL is well known for its role and use in the facilitation of the design process of electronic and digital systems.

Briefly summarized, the color compensation method and the processor and the electronic device disclosed in some embodiments of the present invention can perform the color saturation compensation to enhance the saturation of an original image in events that the screen brightness and/or ambient brightness are too low. In other words, even the current light brightness into the human eyes is very low (i.e. it is dark for the human eyes), the color saturation compensation can be performed to enhance the display quality for the human eyes. Furthermore, the color compensation method and the processor and the electronic device disclosed in some other embodiments of the present invention can perform the color saturation compensation to enhance the saturation of an original image according to human eye color sensibility information. With reference to human eye color sensibility information, an appropriate or optimal compensation may be achieved to accommodate sensing capabilities of human eyes.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device, capable of displaying and performing color compensation, comprising:

a screen, configured to display images;

a sensor, configured to sense ambient light of the electronic device; and a processor, configured to:

receive an original image, obtain one or more brightness values for the original image from both of a screen brightness value of the screen and an ambient brightness value generated according to a sensing result of the sensor, determine whether each of the one or more brightness values is lower than a corresponding one of one or more threshold values, respectively, and enable a color enhancement mode in events where each of the one or more brightness values is lower than the corresponding one of one or more threshold values, respectively, wherein in the color enhancement mode, the processor performs a color saturation compensation to enhance a saturation of the original image, and wherein the screen displays a compensated image according to the compensation result.

2. The electronic device of claim 1, wherein the processor determines the screen brightness value according to a displayed content brightness value and one of a backlight brightness value and the ambient brightness value.

3. The electronic device of claim 1, wherein the one or more brightness values are the screen brightness value of the electronic device.

4. The electronic device of claim 1, wherein the one or more brightness values are ambient brightness value of the electronic device.

5. The electronic device of claim 1, wherein the one or more brightness values are the screen brightness value and the ambient brightness value of the electronic device.

6. The electronic device of claim 1, wherein the processor performs the color saturation compensation according to human eye color sensibility information.

7. The electronic device of claim 6, wherein the human eye color sensibility information comprises an optimal human eye color sensibility value and a current human eye color sensibility value.

8. The electronic device of claim 7, wherein in performing the color saturation compensation, the processor determines a compensation factor according to the ratio of the optimal human eye color sensibility value to the current human eye color sensibility value and compensates the saturation of the original image with the compensation factor.

9. A processor, capable of performing color compensation in an electronic device comprising a screen, comprising:

a display unit, configured to generate an original image; and a compensation circuit, configured to receive the original image, obtain one or more brightness values for the original image from both of a screen brightness value of the screen and an ambient brightness value of the electronic device, determine whether each of the one or more brightness values is lower than a corresponding one of one or more threshold values, respectively, and enable a color enhancement mode in events where each of the one or more brightness values is lower than the corresponding one of one or more threshold values, respectively, wherein in the color enhancement mode, the compensation circuit performs a color saturation compensation to enhance a saturation of the original image and provides a compensated image to be displayed on the screen of the electronic device according to the compensation result.

10. The processor of claim 9, wherein the compensation circuit determines the screen brightness value according to a displayed content brightness value and one of a backlight brightness value and the ambient brightness value.

11. The processor of claim 9, wherein the one or more brightness values are the screen brightness value of the electronic device.

12. The processor of claim 9, wherein the one or more brightness values are ambient brightness value of the electronic device.

13. The processor of claim 9, wherein the one or more brightness values are the screen brightness value and the ambient brightness value of the electronic device.

14. A color compensation method for compensating images for display in an electronic device comprising a screen, comprising:

obtaining one or more brightness values for an original image from both of a screen brightness value and an ambient brightness value of the electronic device;

determining whether each of the one or more brightness values is lower than a corresponding one of one or more threshold values, respectively; and enabling a color enhancement mode in events where each of the one or more brightness values is lower than the corresponding one of one or more threshold values, respectively, wherein the color enhancement mode comprises performing a color saturation compensation to enhance a saturation of the original image for display on a screen of the electronic device.

15. The color compensation method of claim 14, wherein the screen brightness value is determined according to a displayed content brightness value and one of a backlight brightness value and an ambient brightness value.

16. The color compensation method of claim 14, wherein the one or more brightness values are the screen brightness value of the electronic device.

17. The color compensation method of claim 14, wherein the one or more brightness values are ambient brightness value of the electronic device.

18. The color compensation method of claim 14, wherein the one or more brightness values are the screen brightness value and the ambient brightness value of the electronic device.

19. A color compensation method for an electronic device, comprising:

obtaining one or more brightness values for an original image, wherein the one or more brightness values comprise both of a screen brightness value and an ambient brightness value of the electronic device;

determining whether each of the one or more brightness values is lower than a corresponding one of one or more threshold values, respectively; and enabling a color enhancement mode in events where each of the one or more brightness values is lower than the corresponding one of one or more threshold values, respectively, wherein the color enhancement mode comprises performing a color saturation compensation to enhance a saturation of the original image for display on a screen of the electronic device.

* * * * *